US005497752A

United States Patent [19]

Sagisaka et al.

[11] Patent Number: 5,497,752

[45] Date of Patent: Mar. 12, 1996

[54] DEVICE FOR CONTROLLING FUEL INJECTION OF AN INTERNAL COMBUSTION ENGINE

[75] Inventors: Yasuo Sagisaka, Komaki; Masakazu Yamada, Nagoya; Masakazu Ninomiya, Kariya; Kiyonori Sekiguchi, Okazaki, all of Japan

[73] Assignees: Nippondenso Co., Ltd., Kariya; Nippon Soken, Inc., Nishio, both of Japan

[21] Appl. No.: 184,142

[22] Filed: Jan. 21, 1994

[30] Foreign Application Priority Data

Jan. 22, 1993 [JP] Japan ..... 5-009538

[51] Int. Cl.[6] ..... F02D 41/06

[52] U.S. Cl. ..... 123/491

[58] Field of Search ..... 123/491

[56] References Cited

U.S. PATENT DOCUMENTS 4,184,460 1/1980 Harada et al. ..... 123/491

4,438,748 3/1984 Ikeura et al. ..... 123/491

FOREIGN PATENT DOCUMENTS 57-024427 2/1982 Japan .

62-282140 12/1987 Japan .

1-310138 12/1989 Japan .

*Primary Examiner*—Andrew M. Dolinar

*Attorney, Agent, or Firm*—Cushman, Darby & Cushman

[57] ABSTRACT

A device for controlling fuel injection of an internal combustion engine which is capable of preventing the A/F ratio from becoming over-rich immediately after the engine is started to decrease the emission of hydrocarbons. An intake pipe is connected to a four-cylinder spark ignition-type gasoline engine, and an injector for injecting fuel is disposed in the intake pipe for each of the cylinders of the engine. An electronic control unit (ECU) controls fuel injection through the injector in an amount corresponding to the running condition of the engine. When the number of revolutions of the engine reaches a predetermined value (e.g., 500 to 1000 rpm), the ECU judges that complete combustion has occurred and then decreases the amount of fuel injected through the injector during a period in which the amount of fuel adhered to the wall surfaces is excessive.

5 Claims, 13 Drawing Sheets

STARTER SIGNAL
ON
OFF

LARGE
NE
(rpm)
N1
0

LARGE
PM
(mmHgabs)
P1
0

+
FDASE
(%)
0

LARGE
TAU
(ms)
0

LEAN
A/F
ratio
RICH

HC

FLAG F1
1
0
TIME
T1 T2 T3

STARTER SIGNAL
ON
OFF

LARGE
NE
(rpm)
0

LARGE
PM
(mmHgabs)
0

+
F DASE
(%)
0

LARGE
TAU
(ms)
0

LEAN
A/F ratio
RICH

HC
TIME
T1 T2

DEVICE FOR CONTROLLING FUEL INJECTION OF AN INTERNAL COMBUSTION ENGINE

BACKGROUND OF THE INVENTION

1. Field of the Invention

The present invention relates to a device for controlling fuel injection of an internal combustion engine.

2. Description of the Related Art

According to Japanese Unexamined Patent Publication (Kokai) No.1-310138, the amount of fuel injection is increased during starting to reliably start the engine. After the initial explosion, the amount of fuel injection is decreased at predetermined times in order to prevent an excess supply of fuel and to prevent the spark plugs from smoldering.

Immediately after the complete combustion starts, however, it is impossible to decrease the emission of hydrocarbons due to an over-rich air-fuel ratio (A/F ratio) as indicated by A in FIG. 12E. In FIG. 12D, injection pulse TAU is changed from a starting mode to a running mode after a predetermined number of revolutions NE (timing T1) of the engine. After starting, the injection pulse is obtained by correcting a basic injection amount (Tp) using a water temperature increment (FWL) and an after-the-start increment (FASE).

SUMMARY OF THE INVENTION

The object of the present invention is to provide a device for controlling fuel injection of an internal combustion engine which prevents the A/F ratio from becoming over-rich immediately after the start to decrease the emission of hydrocarbons.

In order to achieve the above-mentioned object, the present invention provides a device for controlling fuel injection of an internal combustion engine. An injector injects fuel into an intake pipe of an internal combustion engine. A fuel injection control means injects fuel in an amount corresponding to the running condition of the internal combustion engine through the injection. A complete combustion detecting means detects the occurrence of a complete combustion of the internal combustion engine at the start thereof, and a decreasing means decreases the amount of fuel injected through the injector during a period immediately after the engine is started in which the amount of fuel adhered to the inner wall surfaces of the intake pipe is excessive after complete combustion has been achieved and detected by the complete combustion detecting means.

The present invention is operated as described below. The fuel injection control means injects the fuel through the injector in an amount corresponding to a normal running condition of the internal combustion engine. The decreasing means, on the other hand, decreases the amount of fuel injected through the injector immediately after the engine is started during a period in which the amount of fuel adhered to the inner wall surfaces is excessive after complete combustion has been detected by the complete combustion detecting means.

Immediately after complete combustion is achieved, the fuel that had been injected and adhered onto the inner wall surfaces of the intake pipe enters into the combustion chambers. Thus, the fuel entering into the combustion chambers becomes temporarily excessive. Immediately after complete combustion, however, the amount of the fuel injection is decreased for a predetermined period of time. Therefore, excessive fuel in the combustion chambers is prevented and thus the emission of unburned hydrocarbons caused by over-rich injection is decreased substantially.

DESCRIPTION OF THE PREFERRED EMBODIMENT

Figure 13:
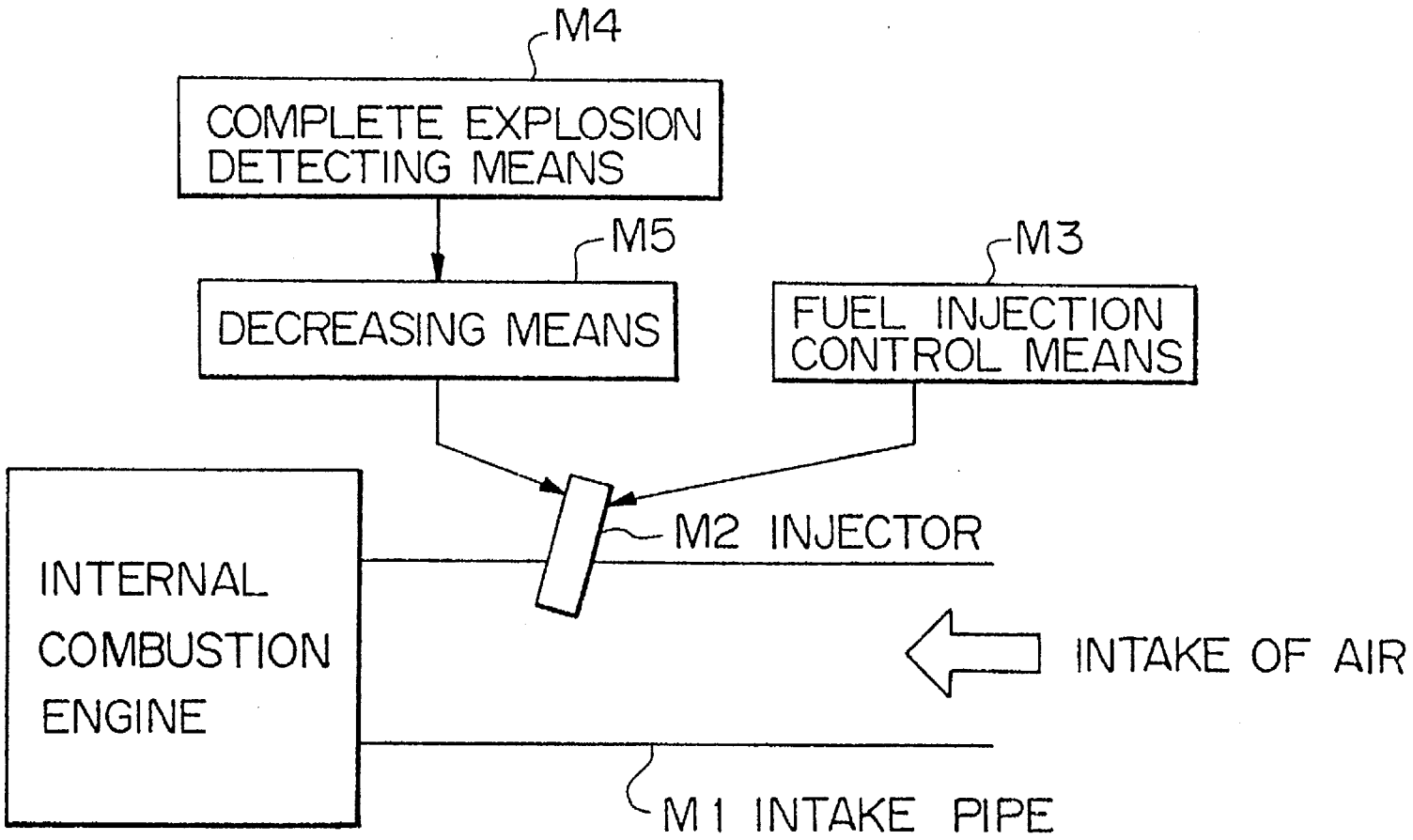
FIG. 13 is a block diagram that corresponds to the claims.

As shown in FIG. 13, the present invention provides an injector M2 which injects fuel into an intake pipe M1. Fuel injection control means M3 injects fuel through injector M2 in an amount corresponding to the normal running condition of the engine. Complete combustion detecting means M4 detects the occurrence of complete combustion when started. Decreasing means M5 decreases the amount of fuel injected through injection M2 just after the engine is started when excessive fuel is adhered to inner wall surfaces of the intake pipe M1.

An embodiment of the present invention will now be described in conjunction with the drawings.

Figure 1:
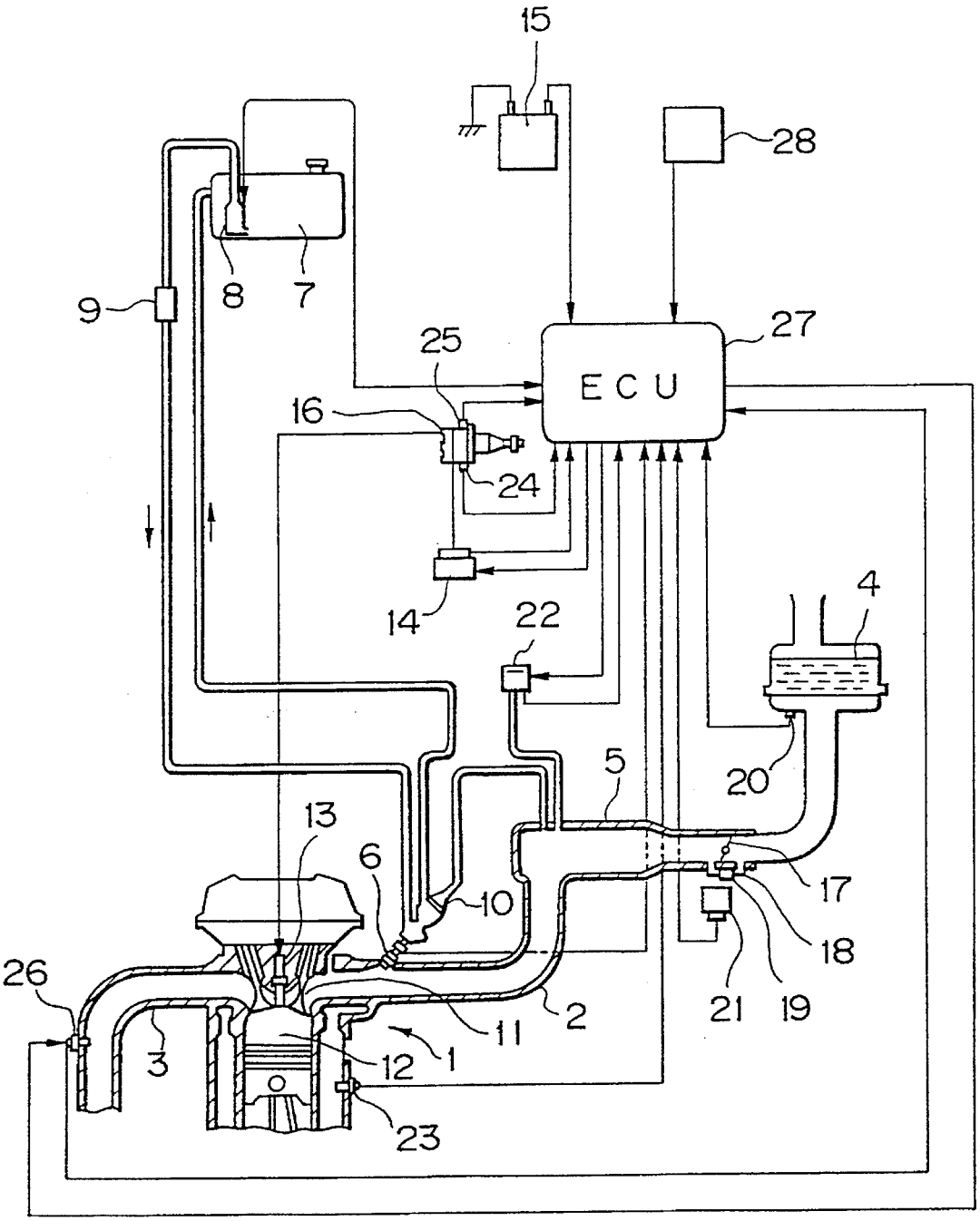
FIG. 1 is a diagram which schematically illustrates the whole device for controlling fuel injection of an internal combustion engine according to an embodiment of the present invention.

FIG. 1 is a diagram which schematically illustrates the whole device for controlling fuel injection of an internal combustion engine. The device is mounted on a vehicle. An intake pipe 2 and an exhaust pipe 3 are connected to a four-cylinder spark ignition-type gasoline engine 1. An air cleaner 4 is provided at the most upstream portion of the intake pipe 2, and the air taken in through the air cleaner 4 is further taken into the intake pipe 2. A surge tank 5 is provided in the intake pipe 2. An injector (fuel injection valve) 6 is provided for the intake pipe (intake port) 2 of each of the cylinders of the engine 1. The fuel in a fuel tank 7 is sucked by a fuel pump 8, fed to a pressure regulator 10 through a fuel filter 9, adjusted for its pressure by the pressure regulator 10, and is returned back to the fuel tank 7. The fuel adjusted to a predetermined pressure is fed to the injector 6 which is controlled to open under electric power supplied thereto from a storage battery 15. Then, the fuel is injected and is mixed with the intaken air. The mixed gas is then fed through intake valves 11 to combustion chambers 12 in the cylinders of the engine 1.

The combustion chambers 12 in the cylinders of the engine 1 are provided with spark plugs 13. A high voltage is formed by an igniter 14 from a voltage of the battery 15 and is distributed by a distributor 16 to the spark plugs 13 of the cylinders.

A by-pass 18 is formed detouring a throttle valve 17 that is provided in the intake pipe 2, and an idle speed control valve 19 is disposed in the by-pass 18. When the engine is idling, the number of revolutions of the engine is adjusted by adjusting the opening degree of the idle speed control valve 19.

An intake air temperature sensor 20 is provided at the most upstream portion of the intake pipe 2 to detect the temperature of the intake air. Further, a throttle open sensor 21 is provided near where the throttle valve 17 is arranged in the intake pipe 2 in order to detect the opening degree of the throttle valve 17. An intra-intake pipe pressure sensor 22 detects the pressure in the intake pipe in the surge tank 5.

The engine 1 is provided with a water temperature sensor 23 which detects the temperature of the engine-cooling water. In the distributor 16 are arranged a cylinder discrimination sensor 24 and a crank angle sensor 25 which generates a crank angle signal after every predetermined crank angle accompanying the revolution of the crank shaft or the cam shaft of the engine 1. The cylinder discrimination sensor 24 generates a cylinder discrimination signal at every predetermined position of a predetermined cylinder accompanying the revolution of the crank shaft or the cam shaft of the engine 1.

The cylinder discrimination signal is the one which detects a predetermined position of a predetermined cylinder (e.g., compression TDC of a first cylinder) one time for at least 720 CA of the crank shaft. The crank angle signals are generated in plural numbers within 180 CA of the crank shaft, and are generated at least at a period of 30 CA or smaller.

The exhaust pipe 3 of the engine 1 is provided with an oxygen concentration sensor 26 which detects the oxygen concentration in the exhaust gas from the engine 1.

An electronic control unit (hereinafter referred to as ECU) 27 serves as fuel injection control means, complete combustion detecting means, and decreasing means, is constituted chiefly by a microcomputer. The ECU 27 receives a signal that is produced by a starter switch 28 when a starter motor is driven. An intake air temperature sensor 20, a throttle open sensor 21, an intra-intake pipe pressure sensor 22, a water temperature sensor 23, a cylinder discrimination sensor 24, and a crank angle sensor 25 are connected to the ECU 27. Upon receipt of signals from these sensors, the ECU 27 detects the temperature of the intake air, the opening degree of the throttle valve 17, the pressure in the intake pipe, the temperature of the engine-cooling water, and the oxygen concentration in the exhaust gas.

The ECU 27 is further connected to the battery 15 and detects the voltage of the battery 15.

Being supplied with electric power from the battery 15, the starter motor (not shown) starts the engine 1 by cranking.

Described below is the operation of the thus constituted device for controlling fuel injection of the internal combustion engine.

FIGS. 2 to 6(B) illustrate processes (shown by flowcharts) executed by the ECU 27. The processes of the ECU 27 will now be described with reference to FIGS. 7A to 7H.

FIGS. 7A to 7H show the changes (i.e., the behavior) of a starter signal, a number of revolutions NE of the engine, an intake air pressure PM, a decrease correction coefficient $F_{DASE}$ after the engine is started, a final injection pulse TAU, an air-fuel ratio (A/F), an HC, and a flag F1, respectively.

Figures 7A, 7B, 7C, 7D, 7E, 7F, 7G, 7H:
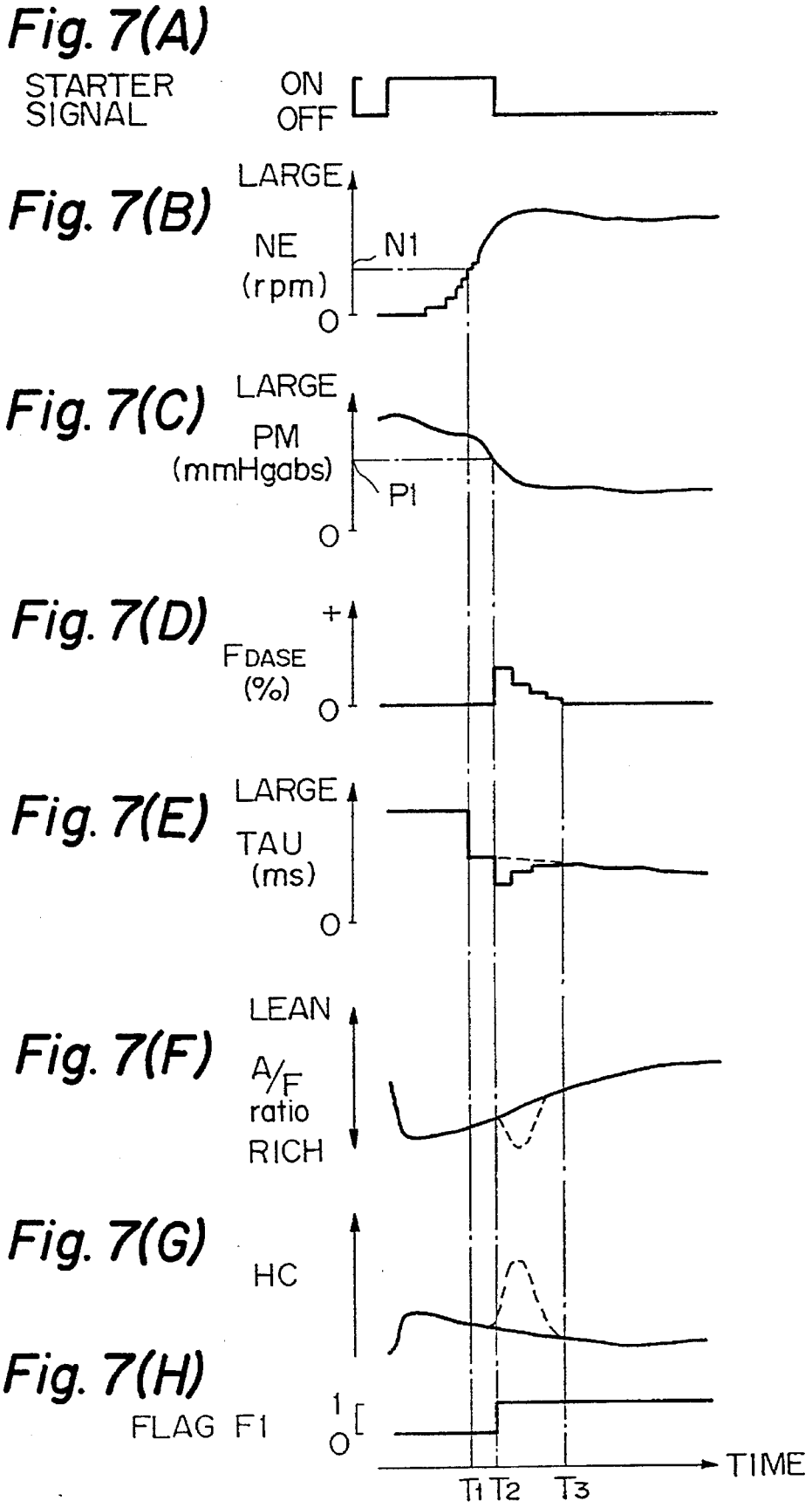
FIGS. 7A to 7H are time charts for explaining the operation of the present invention.

Here, at a predetermined number of revolutions NE (time T1 in FIGS. 7A to 7H) of the engine, the final injection pulse TAU is changed from an injection pulse during engine starting into an injection pulse after the engine is started. At time T2 in FIGS. 7D and 7E, the decrease correction coefficient $F_{DASE}$ after the engine is started is added to obtain a final injection pulse TAU that has been decreased. In FIG. 7E, the final injection pulse TAU indicated by a broken line represents the case where no processing is effected by the decrease correction coefficient $F_{DASE}$ after the engine is started.

The flag F1 is set to 0 when the key switch is turned on and is set to 1 at time T2 at which the amount of fuel starts decreasing after the engine is started.

Figure 2:
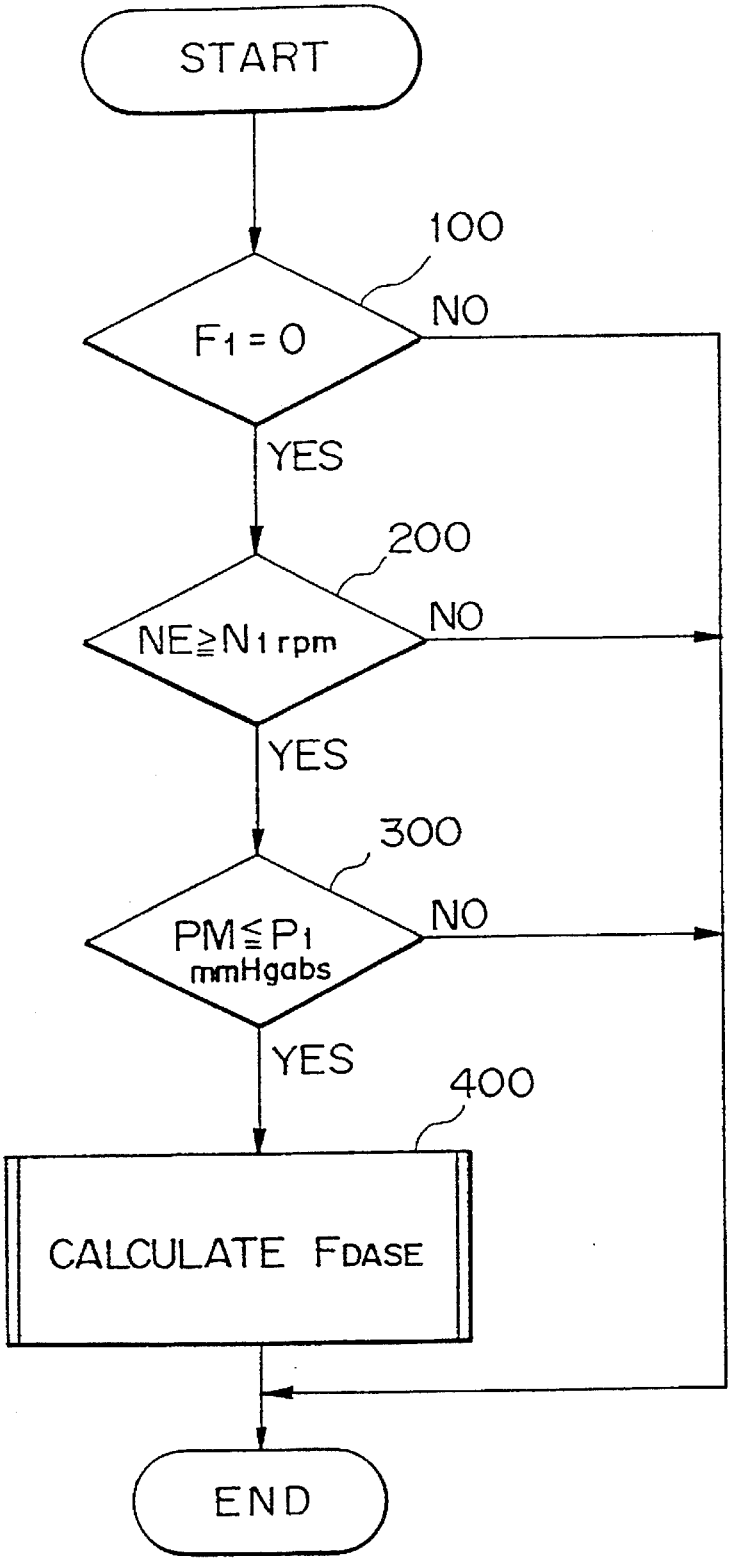
FIG. 2 is a flowchart for explaining the operation of the present invention.

The processing (routine) of FIG. 2 is started after every 8 to 20 ms.

In FIG. 2, the ECU 27 discriminates whether the flag F1 is set to 0 or not at a step 100. When F1 =0, it is discriminated at a step 200 whether the number of revolutions NE of the engine is greater than a predetermined value N1 or not to discriminate whether a complete combustion has taken place or not. N1 may be, for instance, 500 to 1000 rpm. That is, according to another aspect of the present invention, the complete combustion detecting means detects the engine speed and so judges that the complete combustion is taking place when the engine speed is greater than a predetermined value. That is, when the number of revolutions NE of the engine is greater than a predetermined value N1, the ECU 27 discriminates at a step 300 whether the absolute pressure (PM) in the intake pipe is smaller than P1 or not. The process at step 300 detects a point P1 (see FIG. 10) at which the amount of fuel adhered to the inner wall is anticipated to decrease greatly immediately after the start of the engine. A concrete pressure of P1 may be r for example r 360 mmHgabs.

When the absolute pressure (PM) in the intake pipe becomes smaller than P1, the ECU 27 at a step 400 calculates the decrease correction coefficient $F_{DASE}$ after the engine is started. This process is illustrated in FIG. 3.

Figure 3:
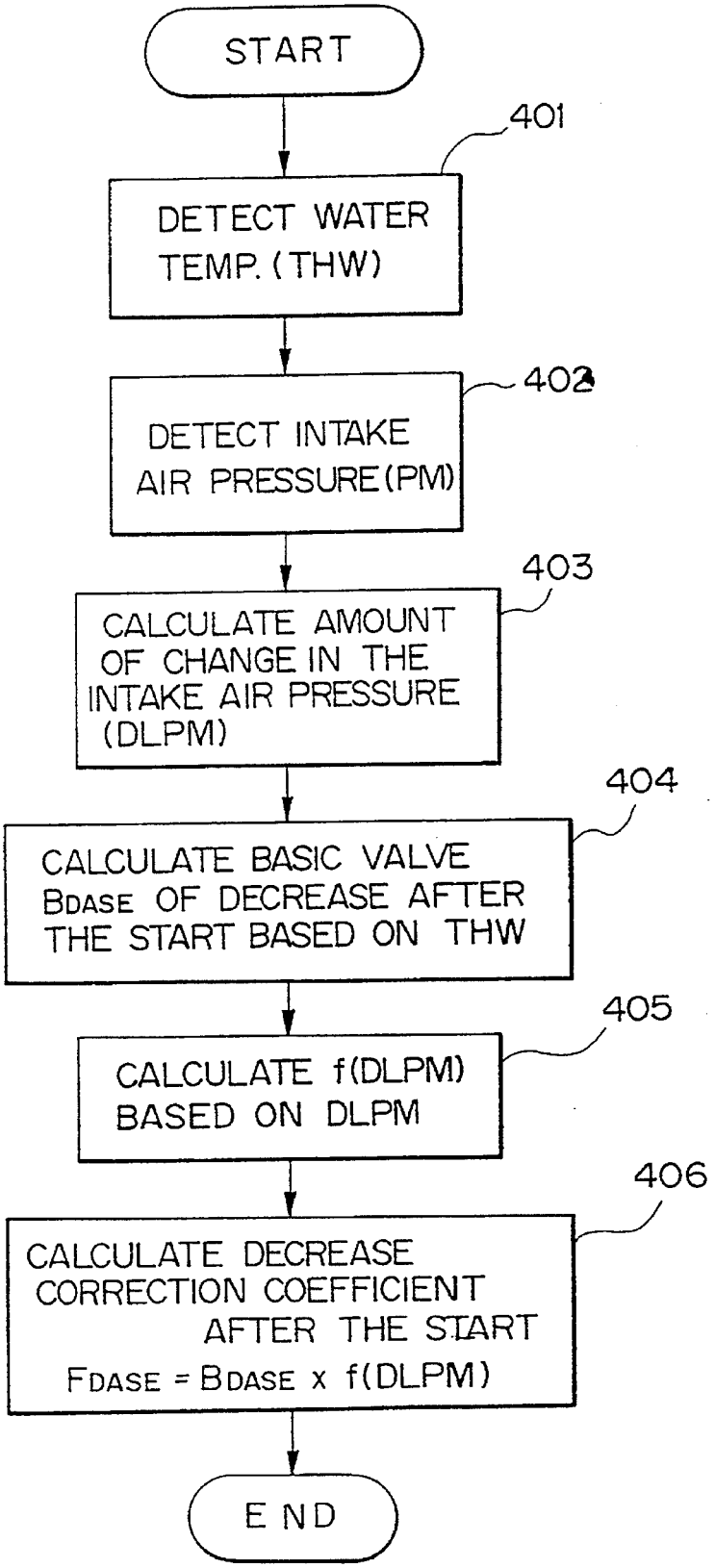
FIG. 3 is a flowchart for explaining the operation of the present invention.

In FIG. 3, the ECU 27 detects the water temperature THW at a step 401 and detects the intake air pressure PM at a step 402. The ECU 27 then calculates the amount of change in the intake air pressure DLPM at a step 403. Then, the ECU 27 calculates at a step 404 a basic value of decrease $B_{DASE}$ after the engine is started based upon the water temperature THW.

Figure 8:
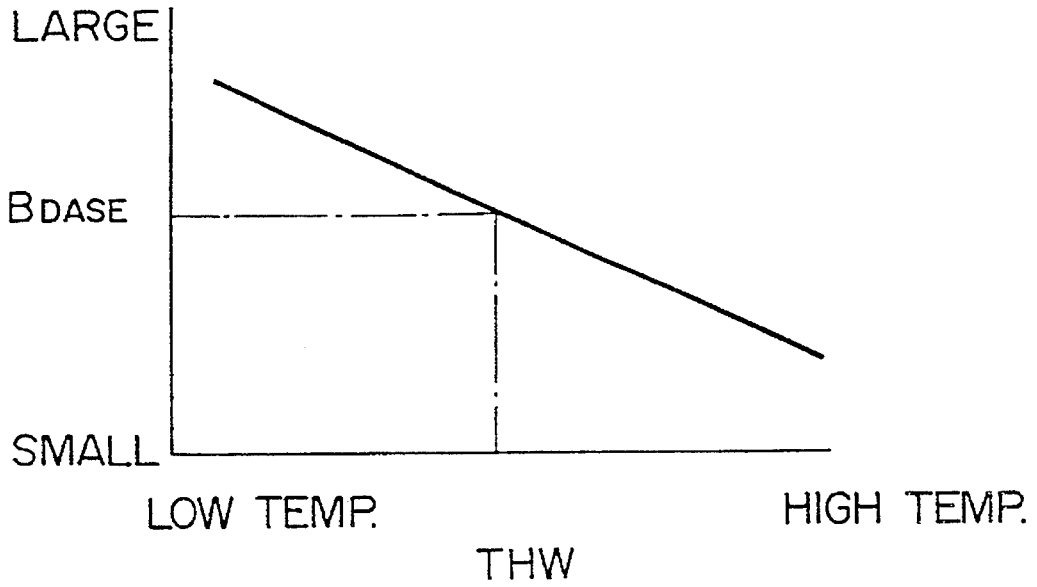
FIG. 8 is a map for finding a basic value of decrease after the start from the water temperature.

At this moment, the ECU 27 calculates the basic value of decrease $B_{DASE}$ after the engine is started based on the water temperature THW by using a map of FIG. 8. The map is of such a nature that the basic value of decrease $B_{DASE}$ after the engine is started increases with a decrease in the water temperature. That is, the lower the water temperature, the larger the amount of decrease.

Figure 9:
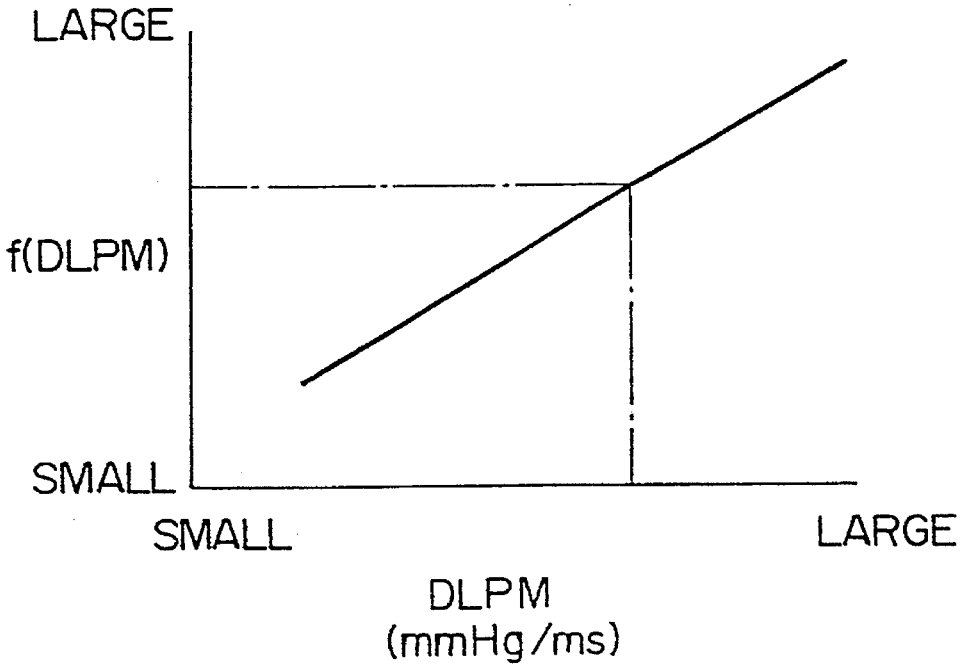
FIG. 9 is a map for finding a decrease coefficient after the start from the amount of change in the intaken air pressure.

Moreover, the ECU 27 calculates at a step 405 the decrease coefficient f (DLPM) after the engine is started based upon the amount of change in the intake air pressure DLPM. At this moment, the ECU 27 calculates the decrease coefficient f (DLPM) after the engine is started based on the amount of change in the intake air pressure DLPM by using a map of FIG. 9. The map is of such a nature that the decrease coefficient f (DLPM) after the engine is started increases with an increase in the amount of change in the intake air pressure DLPM.

The ECU 27 multiplies at a step 406 the basic value of decrease $B_{DASE}$ after the engine is started by the decrease coefficient f (DLPM) after the engine is started to calculate a decrease correction coefficient $F_{DASE}$ ($=B_{DASE}\cdot f(DLPM)$) after the engine is started. At a step 406, the flag F1 is set to 1.

Figure 4:
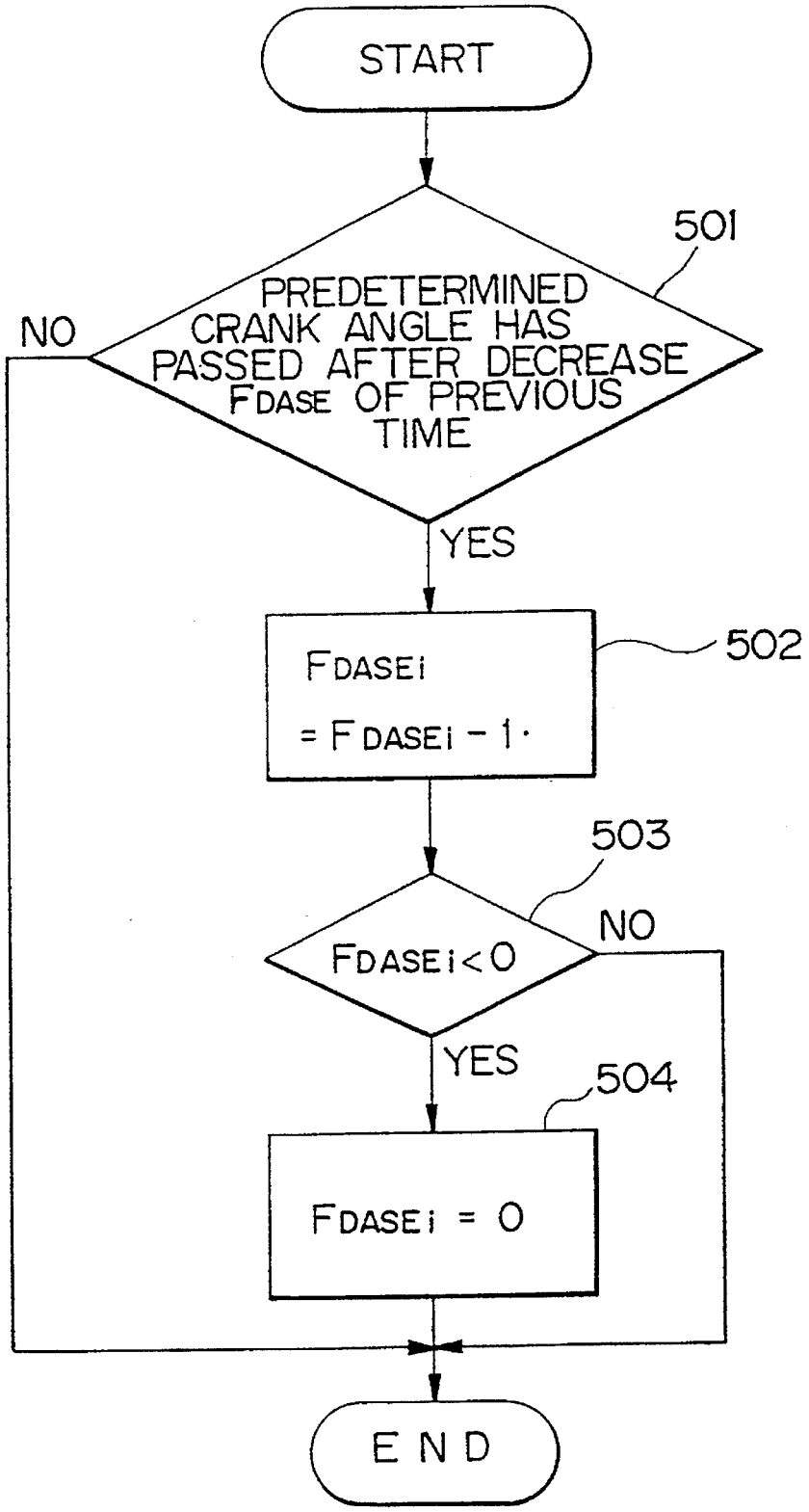
FIG. 4 is a flowchart for explaining the operation of the present invention.

FIG. 4 illustrates the decrease process for the decrease correction coefficient $F_{DASE}$ after the engine is started. This process is started at predetermined crank angles (e.g., at 180° CA).

In FIG. 4, the ECU 27 at a step 501 discriminates whether it is time for decreasing the decrease correction coefficient $F_{DASE}$ after the engine is started. When a predetermined crank angle (e.g., 720° CA) is passed, the decrease correction coefficient $F_{DASE}$ after the engine is started is decreased. When it is time for decreasing $F_{DASE}$ the ECU 27 calculates at a step S02 the decrease correction coefficient $F_{DASEi-1}$ that has been decreased after the engine is started. That is, the decrease correction coefficient FDASEi ($=F_{DASEi-1}\cdot\alpha$) after the engine is started for the current timing is calculated by multiplying the decrease correction coefficient $F_{DASEi-1}$ after the engine is started for a previous time by the decrease factor a (e.g., $\alpha=0.5$).

Furthermore, the ECU 27 works so that the decrease correction coefficient $F_{DASEi}$ after the engine is started that has been decreased will not become smaller than 0 at steps 503 and 504.

Figure 5:
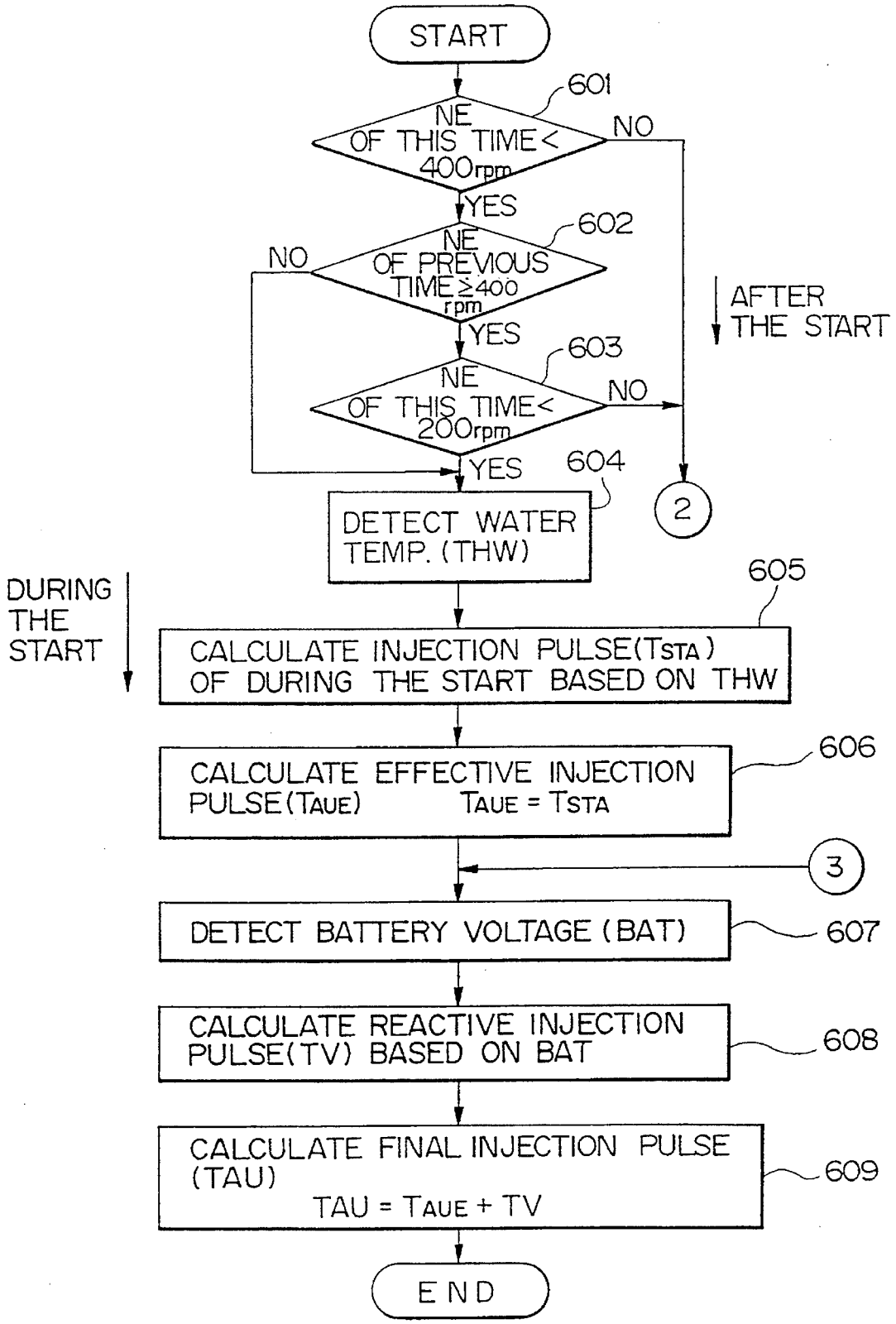
FIG. 5 is a flowchart for explaining the operation of the present invention.
Figures 6A, 6B:
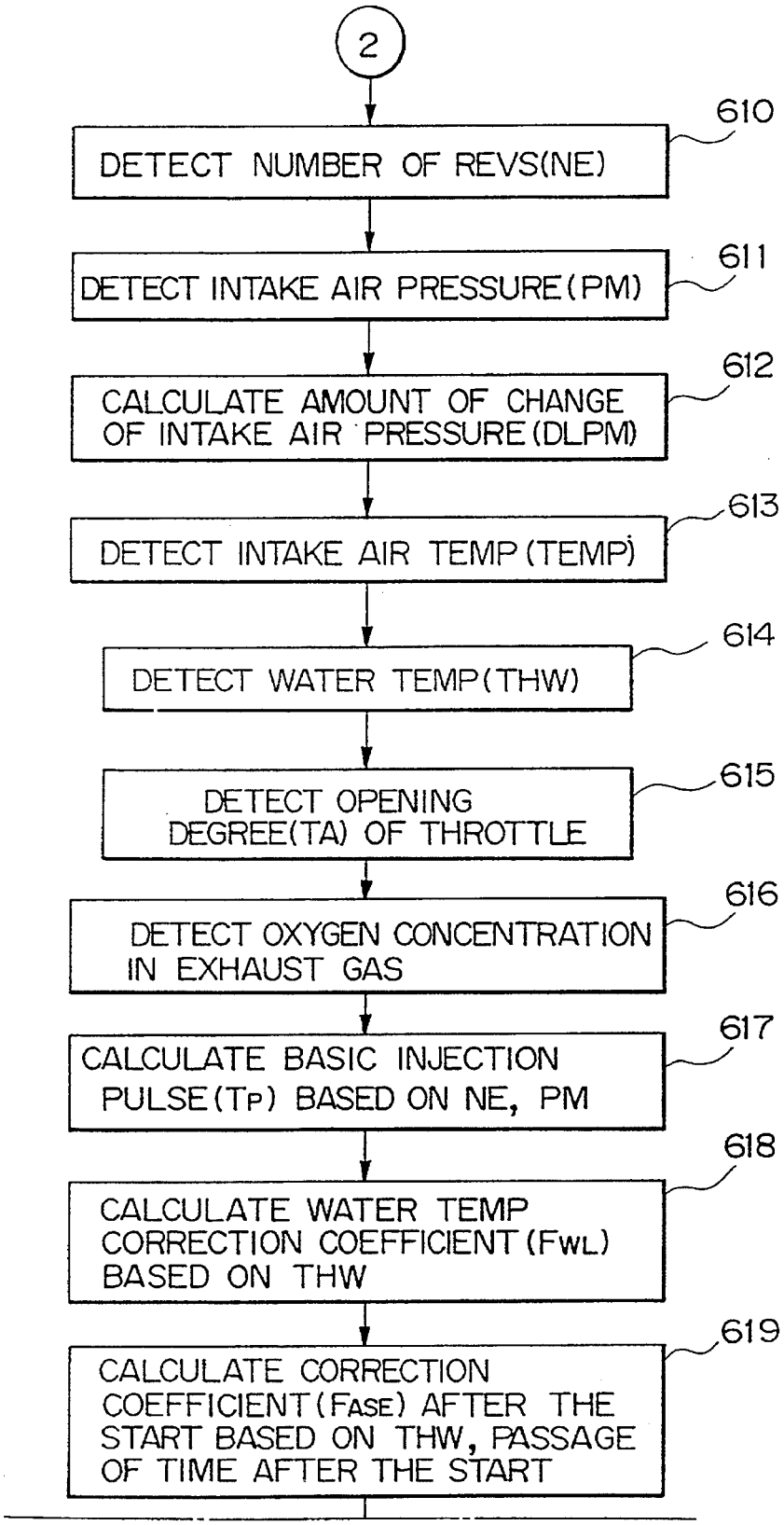
FIGS. 6(A) and 6(B) are flowcharts for explaining the operation of the present invention.

FIGS. 5, 6(A) and 6(B) illustrate processes for calculating synchronizing injection pulses. The routine process is started after every predetermined crank angle.

In FIG. 5, the ECU 27 discriminates at a step 601 whether the number of revolutions NE of the engine for the currently calculated time is smaller than 400 rpm or not. When NE is smaller than 400 rpm, the program proceeds to a step 602 where the ECU 27 discriminates whether the number of revolutions NE of the engine for the previous time is greater than or equal to 400 rpm or not. When it is smaller than 400 rpm, the program proceeds to a step 604. When the number of revolutions is greater than or equal to 400 rpm, it is discriminated at a step 603 whether the number of revolutions NE of the engine at this time is smaller than 200 rpm or not. After the processing of the step 602 or when the number of revolutions NE of the engine at this time is smaller than 200 rpm (starting the engine) at the step 603, the ECU 27 detects at a step 604 the water temperature THW and calculates at a step 605 an injection pulse $T_{STA}$ during the engine start relying upon the water temperature THW. At a step 606, the ECU 27 uses the injection pulse $T_{STA}$ during the engine start as an effective injection pulse $T_{AUE}$.

Moreover, the ECU 27 at a step 607 detects the battery voltage BAT and calculates at a step 608 a reactive injection pulse TV depending upon the battery voltage BAT. The ECU 27 at a step 609 adds the reactive injection pulse TV to the effective injection pulse $T_{AUE}$ to calculate a final injection pulse TAU ($=T_{AUE}+TV$).

Figure 6B:
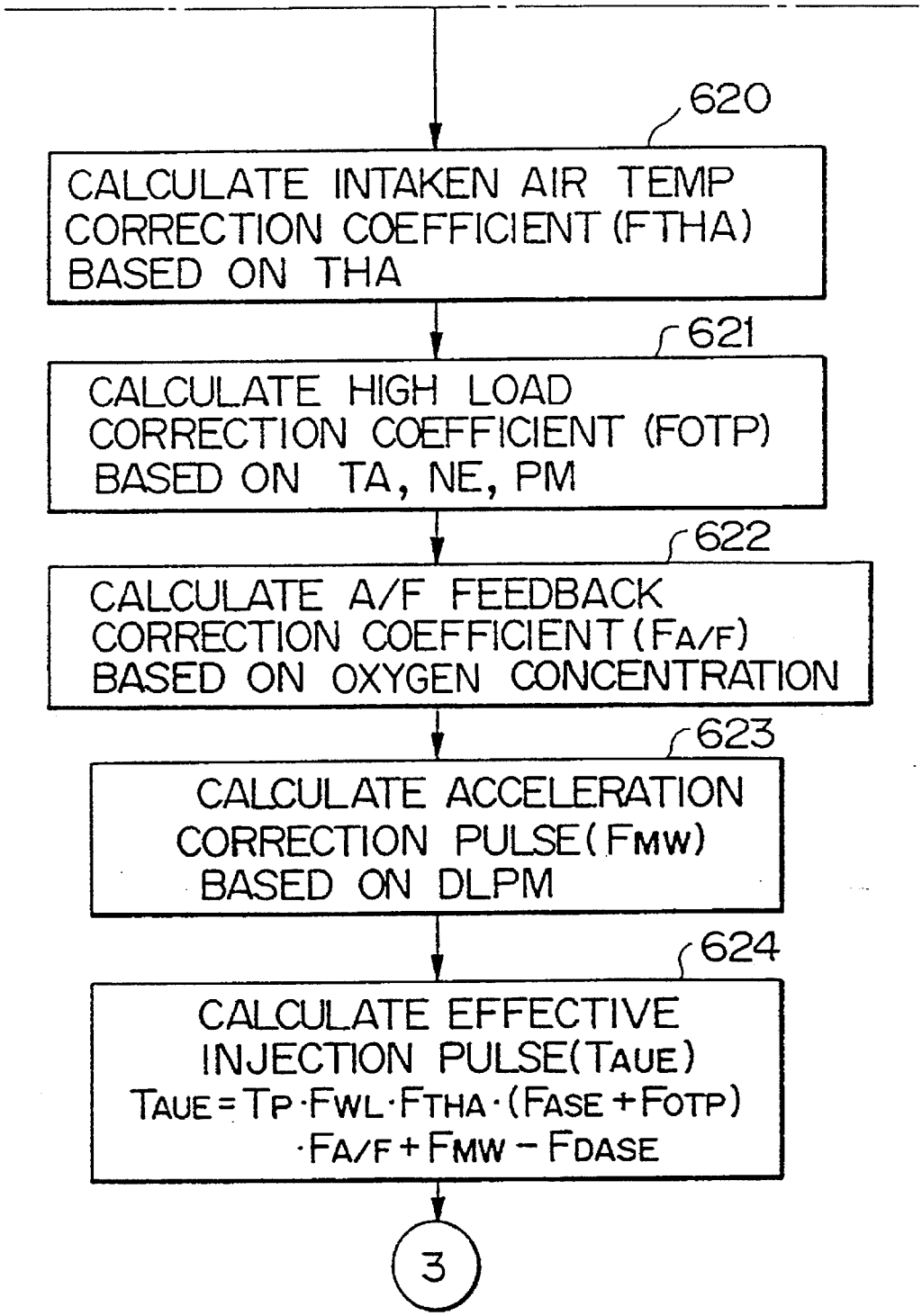

When the number of revolutions NE of the engine at this time is greater than or equal to 400 rpm at the step 601 or when the number of revolutions NE of the engine at this time is greater than 200 rpm (after the engine is started) at the step 603, the ECU 27 proceeds to a step 610 of FIG. 6.

The ECU 27 at the step 610 detects the number of revolutions NE of the engine and detects at a step 611 the intake air pressure PM. The ECU 27 at a step 612 calculates the amount of change in the intake air DLPM and at a step 613 detects the temperature THA of the intake air. The ECU 27 at a step 614 detects the water temperature THW and detects at a step 615 the opening degree TA of the throttle. Then, the ECU 27 at a step 616 detects the oxygen concentration in the exhaust gas and at a step 617 calculates a basic injection pulse Tp depending upon the number of revolutions NE of the engine and the intake air pressure PM. The ECU 27 at a step 618 calculates a water temperature correction coefficient FWL based on the water temperature THW and at a step 619 calculates a correction coefficient $F_{ASE}$ after the engine start based on the water temperature THW and the passage of time after the engine start. The ECU 27 then calculates at a step 620 an intake air temperature correction coefficient $F_{THA}$ based on the intake air temperature THA and at a step 621 calculates a high load correction coefficient $F_{OTP}$ based on the opening degree TA of the throttle, the number of revolutions NE of the engine and the intake air pressure PM.

The ECU 27 then calculates at a step 622 an air-fuel ratio feedback correction coefficient $F_{A/F}$ based on the oxygen concentration in the exhaust gas, and calculates at a step 623 an acceleration correction pulse $F_{mw}$ based on the amount of change in the intake air pressure DLPM. At a step 624, the ECU 27 calculates an effective injection pulse $T_{AUE}$ in compliance with the following equation, $$T_{AUE}=TP\cdot F_{WL}\cdot F_{THA}\cdot(F_{ASE}+T_{OTP})\cdot F_{A/F}+F_{MW}-F_{DASE}$$

After the effective injection pulse $T_{AUE}$ is calculated at the step 624, the ECU 27 proceeds to the step 607 of FIG. 5. Then, as described above, the ECU 27 at the steps 607 and 608 calculates the reactive injection pulse TV based on the battery voltage BAT and at the step 609 adds the reactive injection pulse TV to the effective injection pulse $T_{AUE}$ to calculate a final in jection pulse TAU ($=T_{AUE}+TV$).

In FIGS. 7A to 7H, the time T1 corresponds to the time at which the engine has been started. T1 is a time at which the number of revolutions NE of the engine has reached a predetermined value N1 (e.g., 500 to 1000 rpm). Thereafter in FIG. 7C, the intake air pressure PM takes a predetermined value P1 at time T2. During the period of from T1 to T2, the decrease correction coefficient $F_{DASE}$ after the engine start is calculated by the processes shown in FIGS. 2 and 3. At this moment, the water temperature THW is low in FIG. 8 and the amount of change in the intake air pressure DLPM is large in FIG. 9. Therefore, the basic value $B_{DASE}$ of decrease after the engine start and the decrease coefficient f (DLPM) after the engine start take large values. At the step 406 of FIG. 3, therefore, the decrease correction coefficient $F_{DASE}$ ($=B_{DASE}\cdot f$ (DLPM)) which is a multiplied value takes the largest value. As a result, as the intake air pressure PM assumes a predetermined value P1 at time T2 in FIG. 7C, the effective injection pulse $T_{AUE}$ rapidly decreases at the step 624 in FIGS. 6(A) and 6(B) .

During a subsequent period of from T2 to T3 of FIGS. 7A to 7H, the process is carried out to decrease the decrease correction coefficient $F_{DASE}$ after the engine start that is shown in FIG. 4. As a result, the reduction correction coefficient $F_{DASE}$ after the engine start gradually becomes small (approaches 0).

At time T3 of FIGS. 7A to 7H, the decrease correction coefficient $F_{DASE}$ after the engine start becomes 0.

Here, the predetermined period for effecting the decrease (T2 to T3 in FIGS. 7A to, 7H) is a period for preventing the fuel from being excessively supplied, and varies depending upon the position where the injector is mounted, and on the shape of the intake port. In general, for example, there will be 5 to 10 injections per cylinder.

Figure 10:
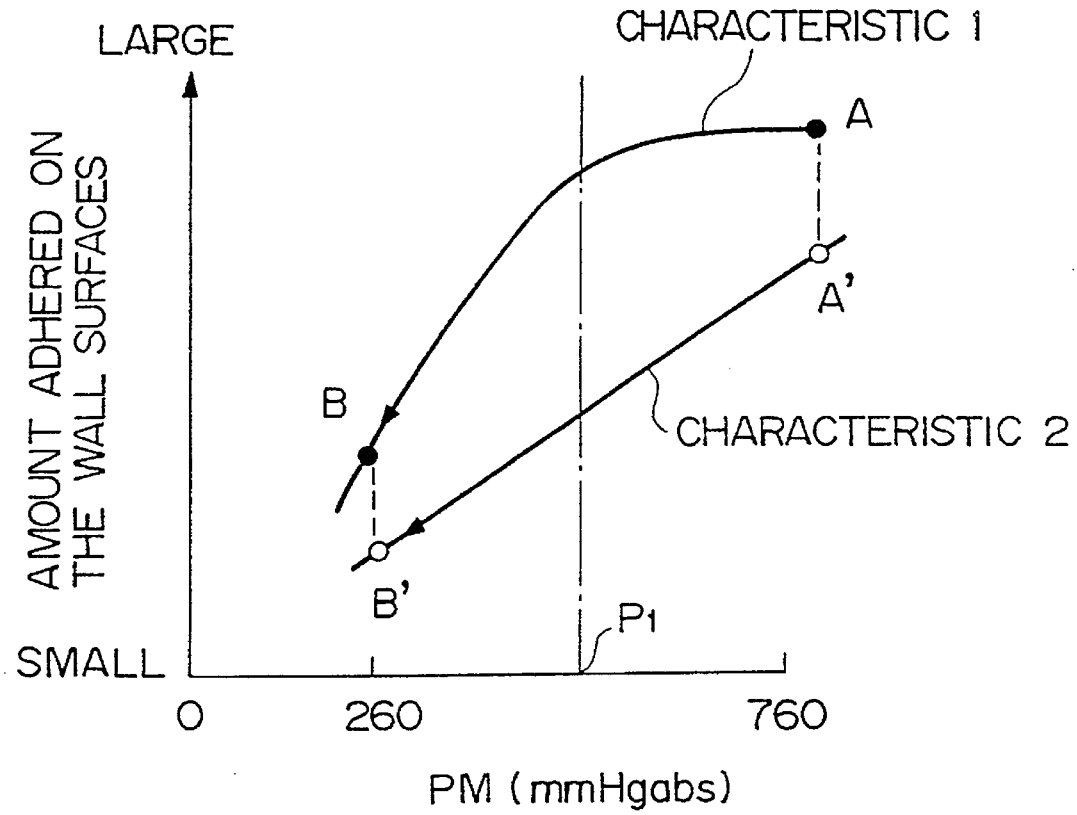
FIG. 10 is a diagram of characteristics illustrating relationships between the intaken air pressure and the amount of fuel adhered to the wall surfaces.
Figures 11A, 11B, 11C, 11D, 11E, 11F, 11G:
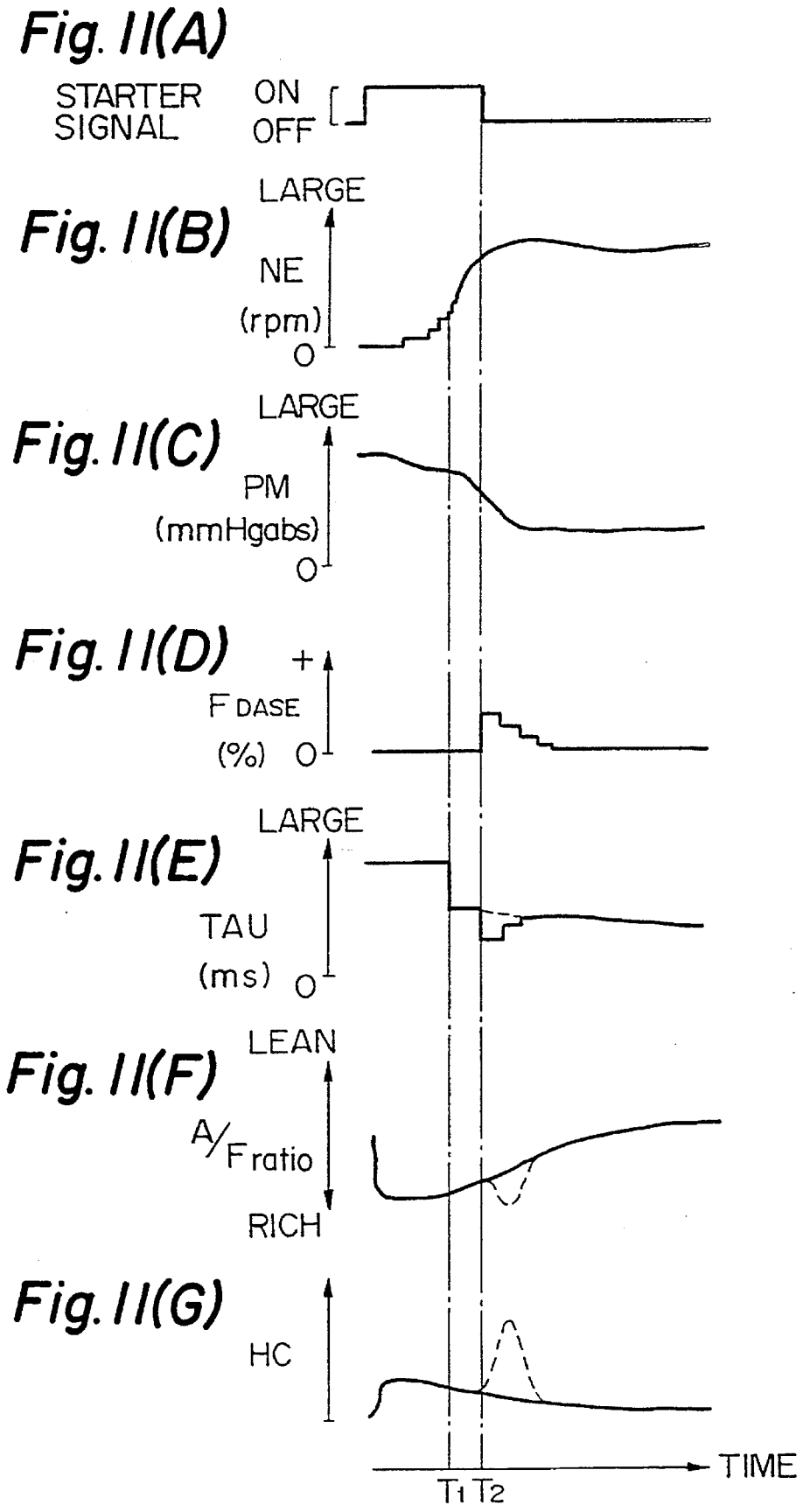
FIGS. 11A to 11G are time charts of another example.
Figures 12A, 12B, 12C, 12D, 12E:
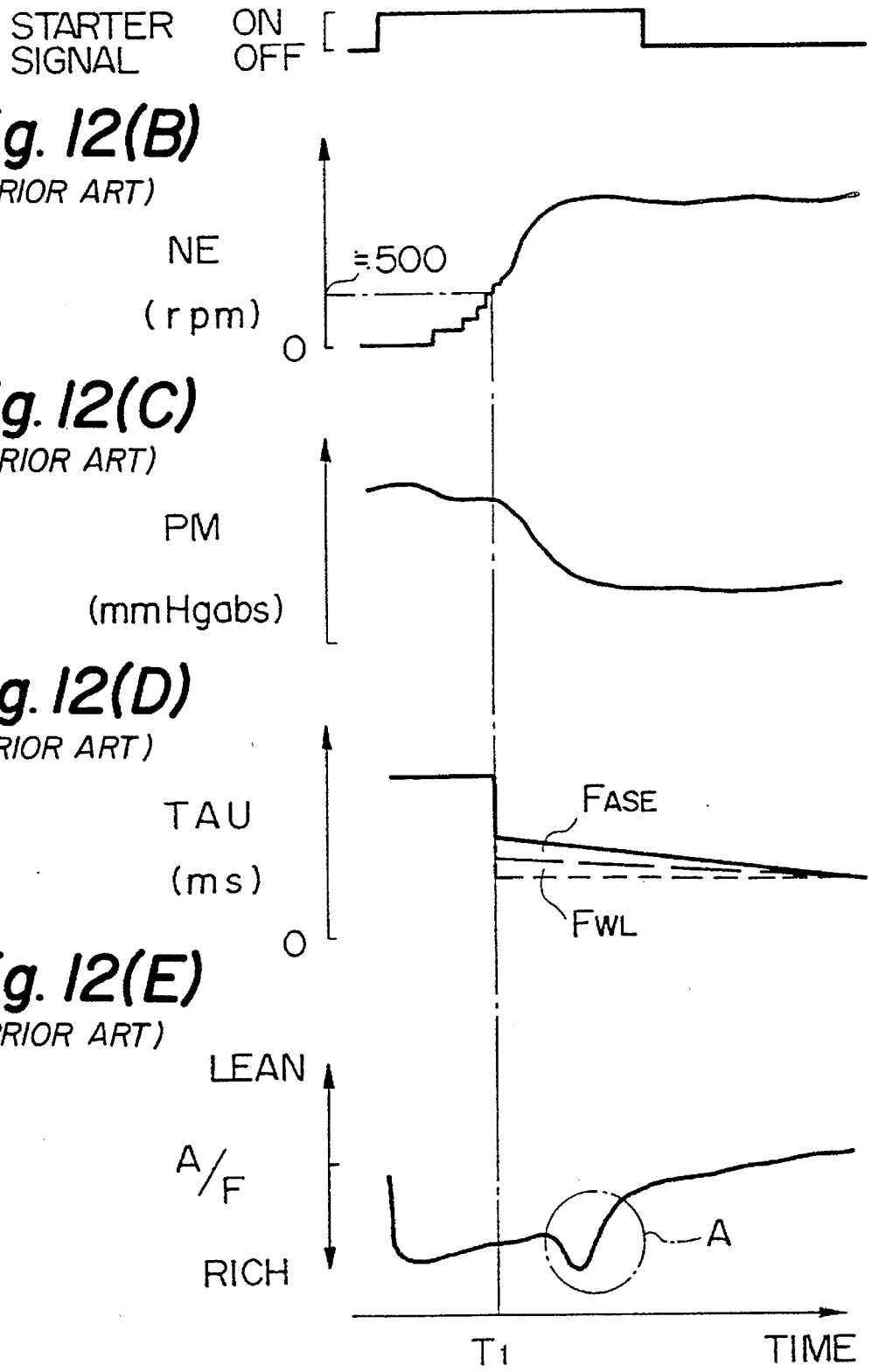
Fig. 12(A) (PRIOR ART)
Fig. 12(B) (PRIOR ART)
Fig. 12(C) (PRIOR ART)
Fig. 12(D) (PRIOR ART)
Fig. 12(E) (PRIOR ART)
FIG. 12A to 12E are time charts used for explaining prior art.

Described here with reference to FIG. 10 is why the amount of fuel must be decreased after the engine start. After the engine has been started (after the number of revolutions has been stabilized), the amount of fuel that adheres on the wall surfaces during the acceleration or deceleration takes nearly a value obtained by multiplying the characteristic 2 by the water temperature correction coefficient. When the intake air pressure PM is reduced, for example, from 760 Hgabs to 260 Hgabs, the amount of fuel is decreased (A'–B'), so that the fuel is supplied in proper amounts (i.e., fuel is supplied in proper amounts into the cylinders) during the deceleration and so that the A/F ratio is almost not disturbed.

During the engine start and immediately after the engine start (until stable idling is established after the complete combustion), however, a characteristic 1 is established in which the fuel adheres to the wall surfaces in amounts larger than those of the characteristic 2. This difference in the characteristics stems from a difference in the dry condition of the wall surfaces. Immediately after the engine start, the wall surfaces have been wetted already with the fuel injected before, and the vaporization of fuel changes depending upon the pressure in the intake pipe only, so that the characteristic 2 is established. During the engine start and immediately thereafter, on the other hand, the wall surfaces have not been sufficiently wetted. Therefore, the fuel must be supplied in amounts for wetting the wall surfaces. During the engine start, furthermore, the fuel must be supplied in large amounts for the above-mentioned reason and because the fuel vaporizes at a reduced rate. Accordingly, the values according to the characteristic 1 become greater than the values according to the characteristic 2. Generally, the fuel starts flowing when it is accumulated in a predetermined amount. This phenomenon develops even in the absence of negative pressure or the air stream. As the negative pressure builds, however, this phenomenon becomes more conspicuous. In the embodiment, therefore, this phenomenon is described by using the pressure P1. When the pressure in the intake pipe takes the predetermined value P1, the fuel adhering to the wall surfaces starts flowing. Therefore, a large amount of fuel is temporarily supplied into the cylinders as represented by the characteristic 1. Immediately after the engine is started, therefore, the process must be executed for decreasing the amount of the fuel with P1 as a triggering point.

According to this embodiment as described above, the CPU 27 (fuel injection control means, complete combustion detecting means, decreasing means) injects through the injector 6 the fuel in a required amount corresponding to the running condition of the engine 1 (internal combustion engine). When the number of revolutions NE of the engine has reached a predetermined value N1 (e.g., 500 to 1000 rpm), furthermore, the ECU 27 determines that complete combustion is accomplished and then decreases the amount of fuel injected through the injector 6 during the period (T2 to T3 in FIGS. 7A to 7H) in which the amount of fuel adhered on the wall surfaces is excessive. That is, immediately after the complete combustion, the fuel that had been injected and adhered on the wall surfaces of the intake pipe is caused to enter into the combustion chambers at one time; i.e., the fuel tends to be temporarily supplied in excess amounts into the combustion chambers. Therefore, immediately after the complete combustion, the amount of fuel injection is decreased for a predetermined period of time in order to decrease the emission of unburned hydrocarbons caused by over-rich air-fuel ratio (A/F ratio). Accordingly, the A/F ratio is prevented from becoming over-rich immediately after the engine is started, and the emission of hydrocarbons can be decreased.

That is, the decreasing means according to the present invention has an adjusting means which decreases, immediately after the complete combustion, the supply of fuel by an amount by which the fuel that had been adhered on the wall surfaces of the intake pipe before the complete combustion is effected in the combustion chambers. The adjusting means adjusts the decreasing amount of fuel depending upon the temperature of the engine, change in the intaken air pressure, and the like.

It is further desired that the adjusting means according to the present invention further has means for decreasing the rate of decrease of fuel.

Here, it should be noted that the present invention is in no way limited to the above-mentioned embodiment only. In the above embodiment, for instance, the triggering conditions for executing the decrease after the engine start were based on the number of revolutions NE of the engine and the intaken air pressure PM. It is, however, also allowable to use a change (ΔNE) in the revolving speed of the engine, a change (DLPM) in the intra-intake pipe air pressure, a battery voltage and a change (Δ+B) in the battery voltage instead. Or, as shown in FIGS. 11A to 11G, the decrease correction coefficient $F_{DASE}$ after the engine start may be calculated (start of decrease in the amount of fuel) at a time when the starter signal changes from the on condition into the off condition.

In the case of the system using an intake air amount sensor, furthermore, the amount Qa of the intaken air or a change (ΔQa) in the amount of the intake air may be used as a triggering condition.

In the aforementioned embodiment, furthermore, the A/F ratio was prevented from becoming over-rich by decreasing the amount of fuel. When the A/F ratio is excessively over-rich, however, the fuel may be cut to prevent the A/F ratio from becoming over-rich.

The complete combustion can be detected relying upon any one of or a plurality of the number of revolutions NE of the engine, intake air pressure PM, number of times of injection, battery voltage, change (ΔNE) in the running speed of the engine, change (DLPM) in the intaken air pressure, change (Δ+B) in the battery voltage, amount Qa of the intake air, and change (ΔQa) in the amount of the intake air.

In the process of decreasing the decrease ratio after the engine start at the step 502 of FIG. 4, the decrease correction coefficient $F_{DASEi-1}$ after the engine start for the previous time was updated by being multiplied by the decrease factor α. It is, however, also allowable to subtract a predetermined value β from the decrease correction coefficient $F_{DASEi-1}$ after the engine start for the previous time for use as the updated decrease correction coefficient $F_{DASEi}$ ($=F_{DASEi-1}-\beta$) after the engine start for the current calculated time.

According to the present invention as described above in detail, the A/F ratio is prevented from becoming over-rich immediately after the engine is started, making it possible to decrease the emission of hydrocarbons.

We claim:

1. A device for controlling fuel injection of an internal combustion engine comprising:

an injector that injects fuel into an intake pipe of said internal combustion engine;

fuel injection control means which controls a supplied amount of fuel to be injected through said injector, said supplied amount of fuel corresponding to a running condition of said internal combustion engine;

complete combustion detecting means that detects a complete combustion condition of said internal combustion engine at a start of said internal combustion engine; and decreasing means that decreases said supplied amount of fuel injected through said injector during a period in which an amount of fuel adhered to wall surfaces of said intake pipe becomes reduced and after said complete combustion condition has been detected by said complete combustion detecting means, said decreasing means including adjusting means which decreases, immediately after said complete combustion condition has been detected, said supplied amount of fuel by an amount by which said amount of fuel that had been adhered to said wall surfaces of said intake pipe before said complete combustion condition is supplied to combustion chambers of said internal combustion engine.

2. A device for controlling fuel injection of an internal combustion engine according to claim 1, wherein:

said complete combustion detecting means detects a speed of said internal combustion engine and so judges that said complete combustion condition is accomplished when said speed of said internal combustion engine becomes greater than a predetermined value.

3. A device for controlling fuel injection of an internal combustion engine according to claim 1, further comprising:

an intra-intake pipe pressure detecting means which detects a pressure in said intake pipe at a moment when said amount of fuel adhered to said wall surfaces of said intake pipe undergoes a great change immediately after said start of said internal combustion engine.

4. A device for controlling fuel injection of an internal combustion engine according to claim 1, wherein:

said adjusting means adjusts said decreased amount of fuel depending upon at least one of a temperature of said internal combustion engine and a change in an intake air pressure.

5. A device for controlling fuel injection of an internal combustion engine according to claim 4, wherein:

said adjusting means further comprises means for decreasing a rate of said decrease of said supplied amount of fuel.

* * * * *